United States Patent [19]

Lehman

[11] Patent Number: 4,468,249

[45] Date of Patent: Aug. 28, 1984

[54] MACHINERY STEEL

[75] Inventor: Albert L. Lehman, Glenview, Ill.

[73] Assignee: A. Finkl & Sons Co., Chicago, Ill.

[21] Appl. No.: 418,800

[22] Filed: Sep. 16, 1982

[51] Int. Cl.[3] ..... C22C 38/06

[52] U.S. Cl. ..... 75/124; 75/125; 75/128 E; 75/128 V; 148/36

[58] Field of Search ..... 75/124 B, 128 V, 128 E, 75/126 G, 123 R, 125, 126 J; 148/36; 164/442, 448

[56] References Cited

U.S. PATENT DOCUMENTS 4,026,727 5/1977 Finkl et al. ..... 75/124 B 4,210,444 7/1980 Bellot ..... 75/126 G

*Primary Examiner*—L. Dewayne Rutledge

*Assistant Examiner*—Debbie Yee

*Attorney, Agent, or Firm*—Baker & McKenzie

[57] ABSTRACT

A machinery steel intended for rugged operating conditions, such as continuous casting rolls, and have near isotropic properties due to the controlled use of calcium, aluminum and melting techniques, and having the following constituents and characteristics:

| | |
|---|---|
| C | from about .15 to about .25 |
| Mn | from about .75 to about 1.25 |
| Si | from about .15 to about .50 |
| Ni | from about 1.00 to about 1.50 |
| Cr | from about 1.00 to about 1.50 |
| Mo | from about .35 to about .45 |
| V | from about .04 to about .06 |
| Al | from about .010 to about .035 |
| Cu | up to .35 max. |
| P | up to .025 max. |
| S | up to .025 max. |
| $H_2$ | up to 2.5 ppm max. |
| $O_2$ | up to 40 ppm max. |
| Ca | from about 15 ppm to about 50 ppm, |
| Fe | balance, plus usual non-deleterious impurities, |

said steel being further characterized by the presence of Type III sulfides being predominate over Type II sulfides.

4 Claims, No Drawings

MACHINERY STEEL

BACKGROUND OF THE INVENTION

The invention relates to a machinery steel which will have high abrasion resistance, high impact properties, high hot and cold cycling properties (i.e.: the ability to rapidly cycle between temperature extremes without loss of strength), and a high percent of Type III sulfide inclusions (i.e.: characterized by round, globular shapes) as contrasted to the Type II stringer type sulfides, with consequent near isotropic RAT properties.

As those skilled in the art appreciate the transverse reduction of area obtained on high strength level steels is used today as a measure of the cleanliness and quality of aircraft quality steels. The transverse reduction of area is often abbreviated as RAT (i.e.: reduction of area-transverse, in distinction to reduction of area-longitudinal). In testing alloy steels in the transverse direction (perpendicular to the longitudinal axis of the bloom, billet, or bar) a considerable range of values can be expected. For further amplification of the property of reduction of area transverse, reference is made to "Republic Alloy Steels," copyright 1961, Republic Steel Corporation, Cleveland, Ohio, pages 258, 259 and 515.

The steel, in its broadest form, includes, in addition to the characteristics mentioned above, the following constituents and characteristics:

| | |
|---|---|
| C | from about .15 to about .25 |
| Mn | from about .75 to about 1.25 |
| Si | from about .15 to about .50 |
| Ni | from about 1.00 to about 1.50 |
| Cr | from about 1.00 to about 1.50 |
| Mo | from about .35 to about .45 |
| V | from about .04 to about .06 |
| Al | from about .010 to about .035 |
| Cu | up to .35 max. |
| P | up to .025 max. |
| S | up to .025 max. |
| $H_2$ | up to 2.5 ppm max. |
| $O_2$ | up to 40 ppm max. |
| Ca | from about 15 ppm to about 50 ppm, |
| Fe | balance, plus usual non-deleterious impurities, |

said steel being further characterized by the presence of Type III sulfides being predominate over Type II sulfides.

Prior attempts to produce such a steel have not been totally successful. In one example, illustrated in the brochure, FX-LC-100, printed by A. Finkl and Sons Company, Chicago, a steel having several similar characteristics is disclosed. However, for certain rugged applications, the requisite toughness was not fully achieved.

Accordingly, it is a primary object of this invention to provide a machinery steel which will have high abrasion resistance, high impact properties, high hot and cold cycling properties, Type III sulfide inclusions, a very low level of Type II sulfide inclusions and excellent strength and toughness under extremely rugged operating conditions.

A further object is to provide a continuous casting roll which will have the above-described properties.

Other objects and advantages of the invention will be apparent to those skilled in the art from the following description.

Carbon is required to impart strength and hardness to the steel. If less than about 0.15 C is present, the necessary strength and hardness for rugged operating conditions, such as continuous casting rolls, will not be obtained. If substantially more than 0.25 C is present weldability necessary for subsequent metalizing will be adversely affected.

Manganese and silicon should be present in the approximate ratio of 3 to 1, Mn to Si. Although both elements aid in hardenability as well as in deoxidation of steel there is an optimum balance for best performance levels. Steels having 3 to 1 Mn to Si ratios maximum will yield far less refractory erosion in teeming, thereby producing cleaner steel.

The nickel, chromium and molybdenum balance indicated in the broad and preferred ranges will impart to the steel, and parts made therefrom such as continuous casting rolls, the ability to thermally cycle rapidly without breakage or substantial erosion for long runs.

The steel should be made by the vacuum process illustrated in U.S. Pat. No. 3,236,635, supplemented, as necessary, by the process illustrated in U.S. Pat. No. 3,501,289.

Aluminum is a most important deoxidizer and for optimum results should be added after vacuum treatment when oxygen is reduced to its lowest level. At this point aluminum recoveries will be very high, resulting in exacting controls chemically.

Sulphur results in stringer type non-metallics; i.e.: Type II inclusions, thereby lowering mechanical properties. Therefore lower sulphur contents will be advantageous in decreasing these objectionable type nonmetallics. Sulfur at a level of 0.025 will be at the outermost limit of acceptability. Preferably, the sulfur should be limited to a maximum of 0.010 so that insufficient sulfur is available, given good melting techniques as described herein, to form a deleterious quantity of Type II inclusions. In essence, only by limiting the sulfur to 0.010 max., which is much below what one skilled in the art would expect to be tolerable, will the round, globular shaped nondeleterious Type III inclusions be assured of being formed in lieu of the deleterious Type II inclusions.

Further, the above method of deoxidation will result in round globular sulfides (Type III) being predominate over Type II inclusions, a result which restores mechanical properties to their highest levels attainable.

Calcium in combination with the other deoxidizers will enhance mechanical properties, aid in sulfur shape control, improve teeming characteristics of the steel, etc. Its presence, however, will require lower $H_2$ levels in steel to avoid "flaking" than would otherwise be expected.

The hydrogen content will become increasingly important as sulfur contents decrease. Lower sulfur steels are more prone to "flaking," thereby requiring lower $H_2$ levels.

Oxygen controls steel cleanliness, alloy recoveries and the types of non-metallic inclusions formed.

In this steel it will be essential to remove as much of the $O_2$ as possible by vacuum treatment before continuing with the final deoxidation and sulfide shape control phases.

Calcium is an important constituent because of its ability to remove sulfur and thus decrease the tendency to form deleterious sulfide inclusions, particularly the highly deleterious Type II inclusions. The key role performed by Ca in 4340 steels is set out in the article, "Calcium Treatment of Steels at Cameron Iron Works," I&SM, August, 1982, pages 15–17, to which reference may be made for a fuller description of the importance of Ca in alloy steels and some of the operating techniques its use requires.

In the steel of the instant invention, Ca should preferably be added by the "bomb" technique.

Specifically, it is preferred that the calcium be bombed in a container using calcium, manganese and silicon mixed with a readily available alloy additive known as Calsibar. Calcium recovery efficiencies substantially higher than those reported in the afore-mentioned article will be obtained; specifically, the addition of one-half pound of calcium per ton of steel will result in the desired final globular type sulfur inclusion.

Continuous casting rolls will be one practical application of the invention. As will be appreciated by those skilled in the art, continuous casting rolls are subjected to some of the most severe operating conditions known to industry. Specifically, the slab passes over a roll just after the point of freezing so the roll is subjected to severe abrasion in contact with a workpiece in the high 2000° F. temperature range. Slabs are not all perfectly straight and, as a consequence, the rolls are subjected to high impacts as the bent slabs slam into the rolls. Further, the rolls are subjected to temperature extremes in service because they are water cooled and thus the face of the rolls vary in temperature from 2000° F. plus temperatures when in contact with a slab to the water cooled temperature which occurs between the passage of successive slabs.

It has recently been discovered that inclusion shape control is important to a successful continuous casting roll. Usually caster rolls fail by breakage. Breakage follows a line of cleavage which can be initiated by an extruded sulfide or inclusion; i.e.: a Type II inclusion. By using the teachings of this invention, the inclusions will be changed from Type II inclusions to a round, globular type of inclusion; i.e.: Type III inclusions, to the point where the Type III inclusions predominate and/or the Type II inclusions are lowered to a frequency such that breakage due to such inclusions will be substantially eliminated. In effect, isotropic properties will be approached. An important factor in reaching this highly desirable end result including high isotropic RAT properties will be the addition of calcium after deoxidation by the process described in U.S. Pat. No. 3,501,289.

Although a specific disclosure of the invention has been made, it will be at once appreciated by those skilled in the art that variations and modifications may be made without departing from the scope of the invention. Accordingly, it is intended that the scope of the invention not be defined by the disclosure herein, but solely by the scope of the hereafter appended claims when interpreted in light of the relevant prior art.

What is claimed is:

1. A machinery steel having high isotropic properties characterized by (a) high uniformity of hardenability in the working range, (b) high abrasion resistance, (c) high impact properties, (d) the ability to rapidly cycle between temperature extremes without loss of strength, (e) said steel consisting essentially of the following constituents in weight percent:

| | |
|---|---|
| C | from about .15 to about .25 |
| Mn | from about .75 to about 1.25 |

-continued

| | |
|---|---|
| Si | from about .15 to about .50 |
| Ni | from about 1.00 to about 1.50 |
| Cr | from about 1.00 to about 1.50 |
| Mo | from about .35 to about .45 |
| V | from about .04 to about .06 |
| Al | from about .010 to about .035 |
| Cu | up to .35 max. |
| P | up to .025 max. |
| S | up to .025 max. |
| $H_2$ | up to 2.5 ppm max. |
| $O_2$ | up to 40 ppm max. |
| Ca | from about 15 ppm to about 50 ppm, |
| Fe | balance, plus usual non-deleterious impurities, |

(f) said steel being further characterized by the presence of Type III round, globular sulfides over Type II stringer type sulfides, and (g) high isotropic RAT properties.

2. A machinery steel having high isotropic properties characterized by (a) high uniformity of hardenability in the working range, (b) high abrasion resistance, (c) high impact properties, (d) the ability to rapidly cycle between temperature extremes without loss of strength, (e) said steel consisting essentially of the following constituents in weight percent:

| | |
|---|---|
| C | from about .17 to about .23 |
| Mn | from about .75 to about 1.00 |
| Si | from about .25 to about .40 |
| Ni | from about 1.20 to about 1.40 |
| Cr | from about 1.05 to about 1.35 |
| Mo | from about .35 to about .45 |
| V | from about .04 to about .06 |
| Al | from about .020 to about .030 |
| Cu | up to .35 |
| P | up to .020 max. |
| S | up to .010 max. |
| $H_2$ | up to 2 ppm max. |
| $O_2$ | up to 30 ppm max. |
| Ca | from about 30 ppm to about 45 ppm |
| Fe | balance, plus usual non-deleterious impurities, |

(f) said steel being further characterized by the presence of Type III sulfides being predominate over Type II sulfides and (g) high isotropic RAT properties.

3. A continuous casting roll, said continuous casting roll being characterized by (a) high uniformity of hardenability in the working range, (b) high abrasion resistance, (c) high impact properties, (d) the ability to rapidly cycle between temperature extremes without loss of strength (e) said steel consisting essentially of the following constituents in weight percent:

| | |
|---|---|
| C | from about .15 to about .25 |
| Mn | from about .75 to about 1.25 |
| Si | from about .15 to about .50 |
| Ni | from about 1.00 to about 1.50 |
| Cr | from about 1.00 to about 1.50 |
| Mo | from about .35 to about .45 |
| V | from about .010 to about .035 |
| Cu | up to .35 max. |
| P | up to .025 max. |
| S | up to .025 max. |
| $H_2$ | up to 2.5 ppm max. |
| $O_2$ | up to 40 ppm max. |
| Ca | from about 15 ppm to about 50 ppm |
| Fe | balance, plus usual non-deleterious impurities, |

(f) said roll being further characterized by the presence of Type III sulfides being predominate over Type II sulfides and (g) high isotropic RAT properties.

4. A continuous casting roll, said continuous casting roll being characterized by (a) high uniformity of hardenability in the working range, (b) high abrasion resistance, (c) high impact properties, (d) the ability to rapidly cycle between temperature extremes without loss of strength, (e) said steel consisting essentially of the following constituents in weight percent:

| | |
|---|---|
| C | from about .17 to about .23 |
| Mn | from about .75 to about 1.00 |
| Si | from about .25 to about .40 |

-continued

| | |
|---|---|
| Ni | from about 1.20 to about 1.40 |
| Cr | from about 1.05 to about 1.35 |
| Mo | from about .35 to about .45 |
| V | from about .04 to about .06 |
| Al | from about .020 to about .030 |
| Cu | up to .35 |
| P | up to .020 max. |
| S | up to .010 max |
| $H_2$ | up to 2 ppm max. |
| $O_2$ | up to 30 ppm max |
| Ca | from about 30 ppm to about 45 ppm |
| Fe | balance, plus usual non-deleterious impurities, |

(f) said roll being further characterized by the presence of Type III sulfides being predominate over Type II sulfides and (g) high isotropic RAT properties.

* * * * *